United States Patent [19]

Ninomiya et al.

[11] Patent Number: 4,545,694

[45] Date of Patent: Oct. 8, 1985

[54] INK SUPPLY DEVICE FOR AN INKING TYPE WIRE DOT PRINTER

[75] Inventors: Yuki Ninomiya, Soka; Haruhiko Yagi, Koshigaya, both of Japan

[73] Assignee: Pentel Kabushiki Kaisha, Tokyo, Japan

[21] Appl. No.: 516,894

[22] Filed: Jul. 25, 1983

[30] Foreign Application Priority Data

| | | | |
|---|---|---|---|
| Jul. 23, 1982 | [JP] | Japan | 57-128371 |
| Jul. 23, 1982 | [JP] | Japan | 57-128372 |
| Mar. 31, 1983 | [JP] | Japan | 58-55648 |
| Aug. 31, 1983 | [JP] | Japan | 58-55647 |

[51] Int. Cl.[4] ..... B41J 3/12; B41J 27/02; B41J 27/20

[52] U.S. Cl. ..... 400/124; 400/470

[58] Field of Search ..... 101/93.05; 400/124, 400/470, 471, 471.1

[56] References Cited

U.S. PATENT DOCUMENTS 4,194,846 3/1980 Zerillo ..... 400/471.1 X

FOREIGN PATENT DOCUMENTS 2546835 4/1977 Fed. Rep. of Germany ..... 400/124
13181 2/1981 Japan ..... 400/471.1
20464 2/1983 Japan ..... 400/124

*Primary Examiner*—Paul T. Sewell
*Attorney, Agent, or Firm*—Robert E. Burns; Emmanuel J. Lobato; Bruce L. Adams

[57] ABSTRACT

An ink supply device for an inking type dot matrix printer wherein an ink occlusion body as an ink dipping portion is provided at the extreme end of a printing head, printing wires are inserted through the ink occlusion body to dip tips of the printing wires in ink, and dot-like characters are printed on a sheet of recording paper with the ink. In the ink supply device, the ink occlusion body has an ink occlusion body mounted on the lower surface thereof in a required spaced relation and a pair of detection electrodes for detection of a quantity of ink in a way that a portion thereof is positioned in said space. Each detection electrode is partly in pressure contact with the ink occlusion body. It is controlled so that when a critical output signal generated when detection electrodes are directly connected by ink overflown as the result of a sufficient supply of ink to the ink occlusion body varies, upper and lower limit values for controlling a supply of ink are set so that an optimal quantity of ink may be always supplied to the ink occlusion body.

9 Claims, 17 Drawing Figures

INK SUPPLY DEVICE FOR AN INKING TYPE WIRE DOT PRINTER

FIELD AND BACKGROUND OF THE INVENTION

The present invention relates to an inking type wire dot printer which dips the tips of printing wires in ink to perform printing of dot characters, and more specifically to an ink supply device which can control a quantity of ink supplied to the printing wires to supply an optimal quantity of ink to the printing wires.

The inking type wire dot printer is designed so that an ink occlusion body as an ink dipping portion composed of felt or sponge is provided at the extreme end of a printing head, printing wires are inserted through the ink occlusion body to dip the tips of the printing wires in ink, and dot-like characters are printed on a sheet of recording paper with the ink. In this inking type dot printer, the quantity of ink within the ink occlusion body decreases as the printing progresses, and therefore, ink is not always sufficiently applied to the wires unless some measures are taken, thus deteriorating the printing quality. To overcome this, in the past, a device is provided to automatically supply ink to the printing head to always maintain the quantity of ink within the ink occlusion body constant so as to always keep the quality of printing at an optimal condition.

In prior art ink supply devices, a pair of detection electrodes are provided in a spaced relation within the ink occlusion body, whereby an AC voltage is applied to one electrode, and the other electrode utilizes the ink in the ink occlusion body as a transfer medium of voltage to detect the voltage. Since this voltage varies with the quantity of ink, a supply of ink from an ink tank is stopped when the detection voltage reaches a predetermined upper value. Therefore, for example, it is controlled so that when the magnet valve is closed to assume a required lower limit value, the magnet valve is opened so as to supply ink from the ink tank to the ink occlusion body. However, the other electrode has a detection voltage which is 0 volt unless the ink occlusion body contains ink to some extent, and thereafter the detection voltage abruptly rises. However, this rise in voltage merely indicates that the pair of electrodes have assumed the conductive condition but the quantity of ink required for printing has not been supplied to the ink occlusion body. When ink is thereafter kept supplying, the detection voltage slowly rises and then the detection voltage is maintained at a certain level. At this time, a quantity of ink enough to provide optimal printing is supplied to the ink occlusion body, and optimal printing is not performed until the upper limit value and lower limit value are set from a voltage value in the vicinity of the maintained voltage. However, in this case, there is a little differential in voltage between the upper limit value and lower limit value, and variation in detection voltage resulting from change in temperature relatively increases resulting in a possible error in detection.

In an attempt of preventing the occurrence of detection error of the quantity of ink resulting from a change in temperature, a proposal has been made wherein a comparing ink occlusion body which is formed of a material similar to that of the ink occlusion body provided on the printing head is provided within an ink tank, the comparing ink occlusion body also having detection electrodes provided thereon so that a difference between the detection voltages of both ink occlusion bodies is obtained to effect temperature compensation, and the quantity of ink is sensed from the voltage differential to control a supply of ink. However, the ink tank is normally loaded on a carriage and as printing progresses, the ink tank is also moved. The ink tank has a space above a liquid level therein, and when the ink tank is moved, the ink rolls to disturb the flow of ions between the detection electrodes of the comparing ink occlusion body, which leads to variation in detection voltage for temperature compensation, thus bringing forth erroneous operation of supplying ink. Moreover, the quantity of ink within the ink tank is much greater than the quantity of ink of the ink occlusion body of the printing head, and therefore, heat transfer on the side of the ink tank is deteriorated and the change in temperature becomes different from that of the ink occlusion body of the printing head. Because of this, there occurs a difference in the temperature characteristic between both the ink occlusion bodies, resulting in a possible error in detection.

SUMMARY OF THE INVENTION

It is an object of the present invention to provide an ink supply device for an inking type wire dot printer which can enhance a detection sensitivity in the neighbourhood of optimal ink occlusion to always render printing of high quality.

It is a further object of the present invention to provide an ink supply device for an inking type wire dot printer which can provide accurate temperature compensation and can perform good inking control.

It is another object of the present invention to provide an ink supply device in which valve means for controlling a supply of ink to a printing ink occlusion body can be made simple in construction and miniaturized to miniaturize the ink supply device and shorten a supply route between an ink tank and the printing ink occlusion body.

In accordance with the present invention, there is provided an ink supply device for an inking type wire dot printer comprising a housing, a plurality of printing wires supported projectably from one end of said housing, a plurality of wire driving means driven so as to individually project the printing wires from one end of the housing, an ink chamber having a printing ink occlusion body provided within the housing into which the printing wires extend, an ink tank having ink supplied to the ink occlusion body, valve means for electrically controlling a supply of ink within the ink tank to the ink occlusion body, a pair of spaced detection electrodes for detection of printing ink, an upper end of which projects from a lower surface to the interior of the housing, the upper end being pressed against the ink occlusion body, and a detection control circuit in which the valve means is controlled to be turned ON or OFF by output signals from the detection electrodes, the ink occlusion body having a lower surface positioned in a required spaced relation from the lower surface of the housing.

In the above described ink supply device, since a spacing is formed between the lower surface of the ink occlusion body and the lower surface of the housing, ink is sufficiently supplied to the ink occlusion body and overflown ink stays in the space to thereby form a conductor resulting from ink alone between the detection electrodes, and abruptly increasing critical output signals are obtained by the detection electrodes different from output signals so far detected through the ink occlusion body. Thus, when the critical output signal is changed, the upper limit value and lower limit value are set to increase the detection sensitivity.

The present invention further provides an ink supply device for an inking type wire dot printer which comprises a comparing ink occlusion body formed of a material similar to that of the printing ink occlusion body, a pair of spaced comparing detection electrodes provided to be pressed against said ink occlusion body, and a sealed ink capsule filled with ink, wherein the detection control circuit compares output signals of the printing ink detection electrodes using an output signal of the comparing electrode as a reference signal to effect ON and OFF control of the valve means by a signal differential obtained therefrom. The reference signal in the good quantity of ink is set by the ink capsule and the reference signal is compared with the output signal of the printing ink detection electrode, and therefore, the reference signal value is not changed by variation either of the quantity of ink within the ink tank or the external temperature thus providing accurate temperature compensation.

The present invention further provides an ink supply device in which the ink tank is formed at the bottom with a through hole, a ball valve of a magnetic material blocking the through hole is movably provided, and magnet means is provided which is mounted externally of the ink tank and adapted to change a position of a ball valve by means of a magnetic force when energized, to form a valve means. With this arrangement, the valve means can be miniaturized, the ink tank is provided on the housing, and a guide which is in communication with the through hole to supply ink to the printing tank occlusion body is provided on the upper surface of the housing to thereby shorten an ink supply route between the ink tank and the printing ink occlusion body.

DESCRIPTION OF THE PREFERRED EMBODIMENTS

Figure 1:
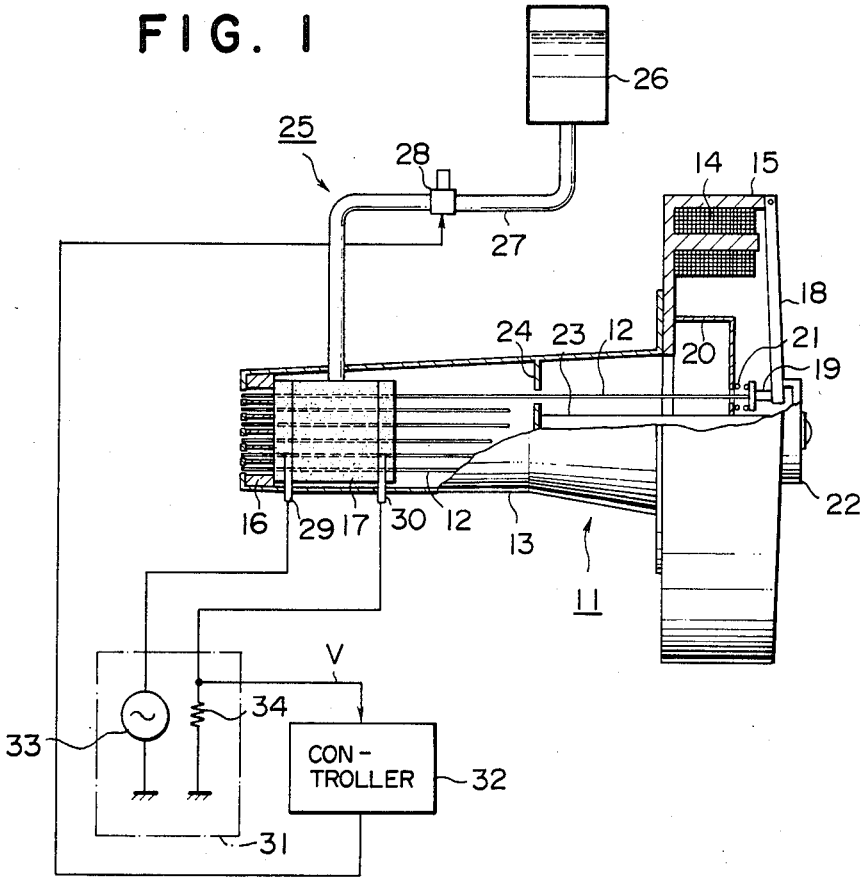
FIG. 1 illustrates, in a partial section, one embodiment of an ink supply device for an inking type wire dot printer in accordance with the present invention.

An ink supply device for an inking type dot printer in accordance with the present invention will now be described with reference to the accompanying drawings. Like elements bear like reference numerals throughout the several embodiments.

Referring now to FIG. 1, a printing head is indicated generally at reference numeral 11. The printing head 11 whose forward end and rear end are open comprises a housing 13 accommodating therein a plurality of printing wires 12 and a cylindrical casing 15 mounted on the rear end of said housing 13 and annularly holding solenoids 14 corresponding in number to that of the printing wires 12. Within the housing 13 are mounted a wire guide 16 for guiding the tip of each printing wire projectably leftward in FIG. 1 and an ink occlusion body 17 positioned at the rear end of the wire guide 16 and through which the printing wires 12 slidably extend. Within the casing 15 there are mounted the solenoids 14 in the number corresponding to that of the printing wires 12 along the inner peripheral walls thereof and at suitable intervals, each of the solenoids having an operating rod 18 one end of which is pivotally mounted on the peripheral wall of the casing 15. The other end of the operating rod 18 engages a keep member 19, and the other end of the printing wire 12 is mounted on the opposite side of the keep member 19. The printing wire 12 is resiliently biased rightward in FIG. 1, when the solenoid is inoperative, by means of a spring 21 inserted between a support bed 20 supported on the bottom wall of the casing 15 and keep member 19. The other end of the operating rod 18 is placed in engagment with a cap 22 to prevent its excessive counterclockwise rotation by means of a resilient force of the spring 21 when the solenoid 14 is inoperative. The cap 22 is mounted on an intermediate wall 24 of the housing 13 by means of a post 23.

An ink supply device generally indicated at reference numeral 25 is mounted on the printing head 11, the ink supply device 25 comprising an ink tank 26, a supply pipe 27 connecting the ink tank 26 with the ink occlusion body 17, a magnet or electromagnetic valve 28 provided in the middle of the supply pipe 27, and a pair of electrodes 29 and 30 for detecting a quantity of ink and being mounted on the ink occlusion body 17 in a spaced relation which will be described later. These electrodes are formed, for example, of platinum which is small in ionization to prevent the occurrence of corrosion resulting from the ink. The detection electrodes 29 and 30 are connected to a detection circuit 31 for electrically detecting the quantity of ink by voltage of the electrodes, the detection circuit 31 being connected to a control circuit 32 adapted to open and close the magnet valve 28 by output signals from the detection circuit. In this detection circuit 31, and AC power source 33 connected to one electrode 29 and a fixed resistor 34 connected to the other electrode are respectively connected in series ground potential.

Figure 2:
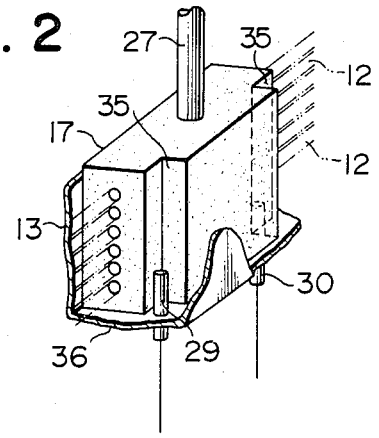
FIG. 2 is a perspective view in partial section showing details of an ink occlusion body in FIG. 1.

As shown in greater detail in FIG. 2, the ink occlusion body 17 is formed from felt or sponge and is approximately rectangular in shape, wherein a plurality of printing wires 12 slidably extend substantially horizontally at vertical intervals. Both corner portions on one side of the ink occlusion body 17 are cut off into an approximately L-shape to form stepped portions 35. The electrodes 29 and 30 are arranged below the stepped portions 35 in a way that the electrodes are made to contact with the stepped portions by a required pressing force so as to hold the stepped portions therebetween. The pressing force of the electrodes 29 and 30 is set relatively greatly to minimize change in contact pressure resulting from a lapse of time and variation in detection level resulting from irregularities of products and provide stabilized detection. The bottom of the ink occlusion body 17 is positioned with a required spacing from upper surface of a bottom plate 36, the spacing being formed by interposing a spacer or the like between the bottom of the occlusion body 17 and the bottom plate 36 though not shown.

Figure 3:
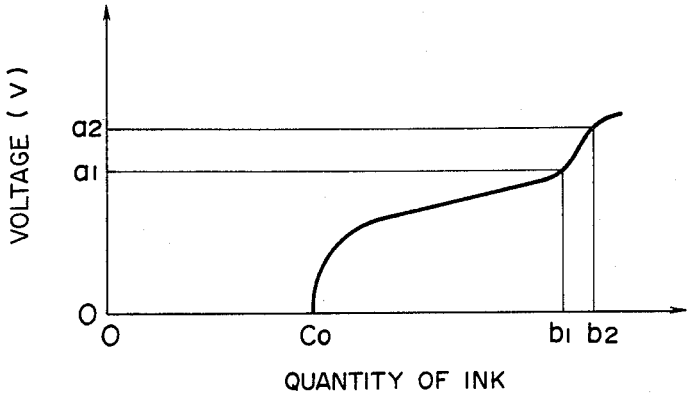
FIG. 3 is a graphic representation for explanation of the relation between a quantity of ink and detection voltage, together with prior art example.

Next, the operation of the electrodes 29 and 30 for detection of the quantity of ink will be described. When ink is supplied to the ink occlusion body 17 through the supply pipe 27 connected to the upper portion thereof, a required quantity of ink is occluded into the ink occlusion body 17 to render the interior thereof in a conductive condition, at which moment, that is, the detection voltage output signal $C_o$ produced by the detectioncircuit 31 of FIG. 3 indicates an initial critical change and abruptly begins to rise. Thereafter, as ink is kept being supplied, the detection voltage gently rises. The occlusion quantity of ink is not enough to dip the printing wires 12 in ink by the ink occlusion body 17. When the ink supply is further kept on to reach the maximum quantity of ink which can be occluded into the ink occlusion body 17, ink slightly overflows from the ink occlusion body 17 and overflows into a space between the ink occlusion body 17 and the bottom plate 36 of the housing 13 to spread over the bottom plate 36. Since a portion between the detection electrodes 29 and 30 is directly brought into conduction by the ink overflown on the bottom plate 36, the detection voltage occurs in a second critical change from the time indicated at $b_1$ of FIG. 3. The occlusion quantity of ink in the ink occlusion body 17 at that time provides the optimum quality of printing. Experiments reveal that if a clearance between the bottom of the ink occlusion body 17 and the bottom plate 36 of the housing 13 is set to 0.5 to 1 mm to detect the presence of conduction by the ink on the bottom plate 36, detection sensitivity more than five times of prior art can be obtained. Even if ink further keeps supplying, the detection voltage hardly rises since the portion between the detection electrodes 29 and 30 becomes conducted (FIG. 3, $b_2$ and thereafter). Accordingly, change in detection voltage of ink with which optimum quality of printing is obtained relative to the occlusion quantity of ink is extremely great. Thus, by setting the upper limit value Vs on the side of the control circuit 32 to $a_2$ of FIG. 3 and the lower limit value Vu to $a_1$ with the detection voltage in the second critical change portion as a reference, there is hardly affected even if a detection error is present due to variation in detection voltage resulting from temperature change or irregularities in products. Thus, it is possible to perform detection of occlusion quantity of ink and supply and control of ink in a positive and stabilized manner.

When the ink occlusion body 17 is filled with ink, ink begins to overflow from the lower portion of the ink occlusion body 17 However, since the detection electrodes 29 and 30 are arranged below the ink occlusion body 17, it is possible to detect the filling condition of ink with accuracy.

Figure 4A:
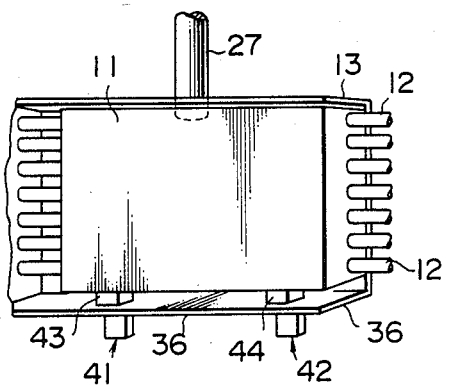
FIG. 4*a* is a persepective view in a partial section showing a second embodiment of the ink occlusion body of FIG. 2.
Figure 4B:
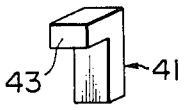
FIG. 4*b* is a perspective view showing an electrode of FIG. 4*a*.

While in the above-described first embodiment, the detection electrodes 29 and 30 are in the form of a linear rod, it should be noted that detection electrodes 41 and 42 can be formed into a plate which is bent in the form of an inverted L-shape, as shown in FIGS. 4*a* and 4*b*. That is, upper horizontal portions 43 and 44 of the detection electrodes 41 and 42, respectively, are positioned in a space between the lower surface of the ink occlusion body 17 and the upper surface of the bottom plate 36 of the housing 13 and secured so as to press the lower surface of the ink occlusion body 17, the lower portions of the detection electrodes 41 and 42, respectively, being projected externally of the bottom plate 36. Thus, the horizontal portions 43 and 44 also serve as a spacer and also retain the space between the ink occlusion body 17 and the bottom plate 36.

Figure 5:
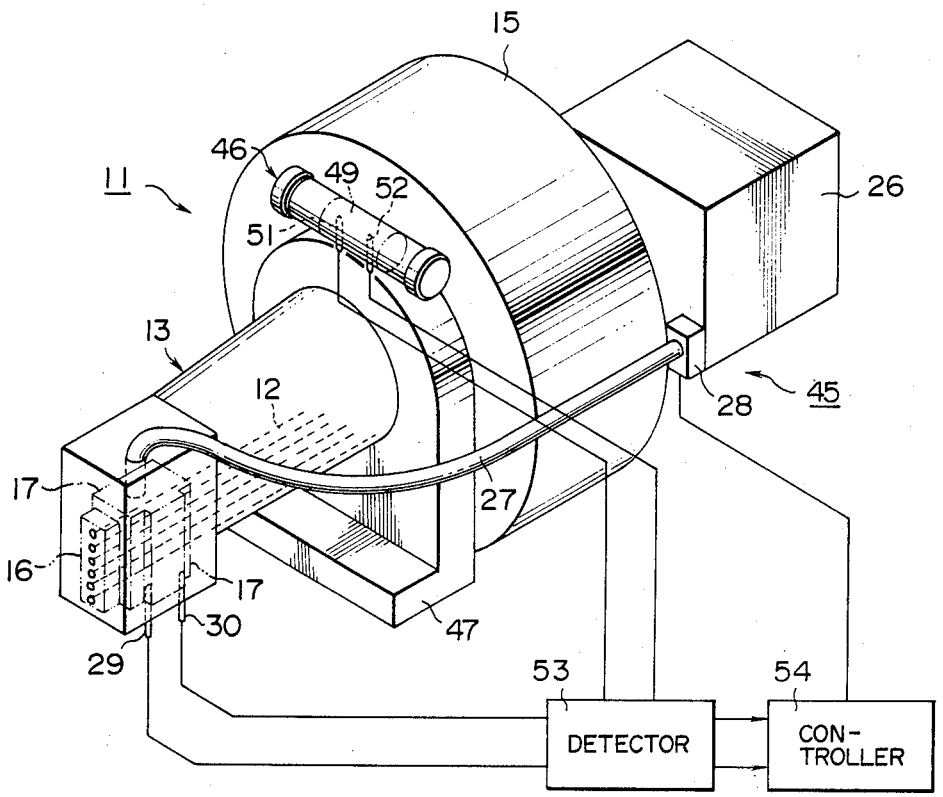
FIG. 5 illustrates a second embodiment of the present invention.
Figure 6:
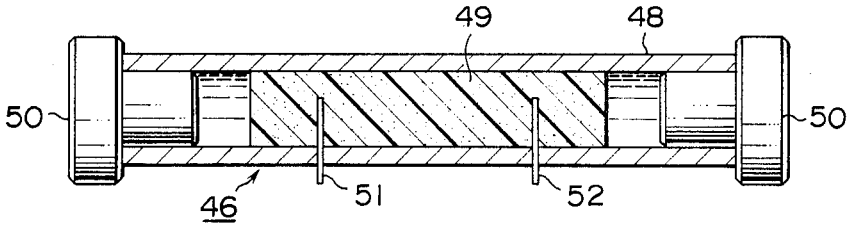
FIG. 6 is a sectional view showing an ink capsule of FIG. 5.
Figure 7:
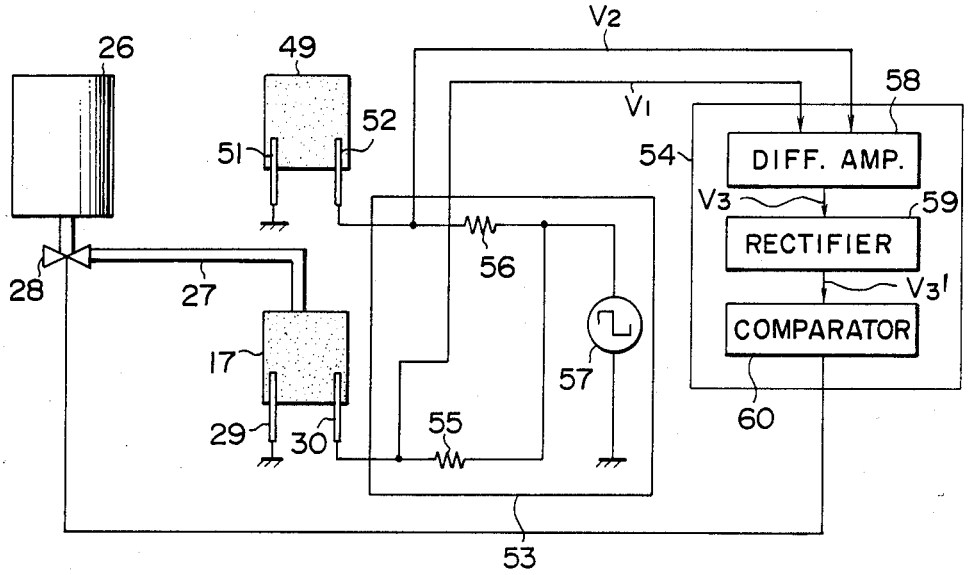
FIG. 7 is a block diagram showing the electric structure in FIG. 5.
Figure 10:
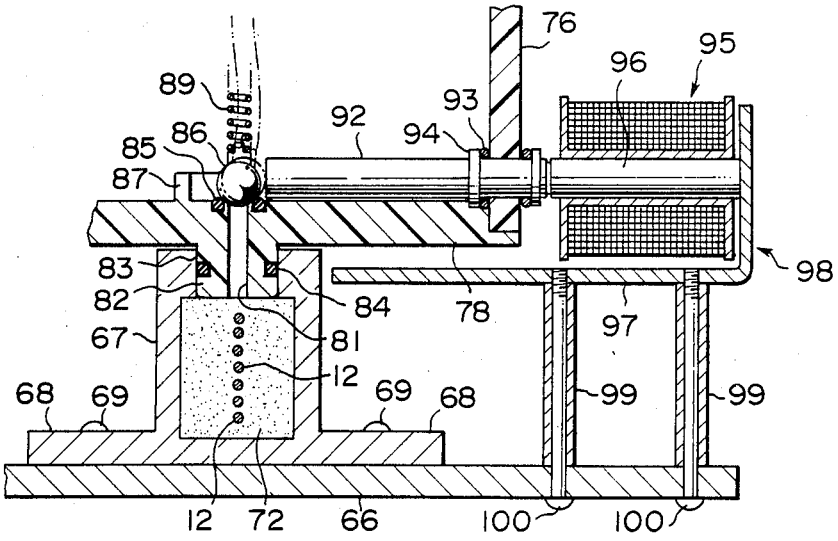
FIG. 10 is a sectional view taken of line B—B of FIG. 8.
Figure 8:
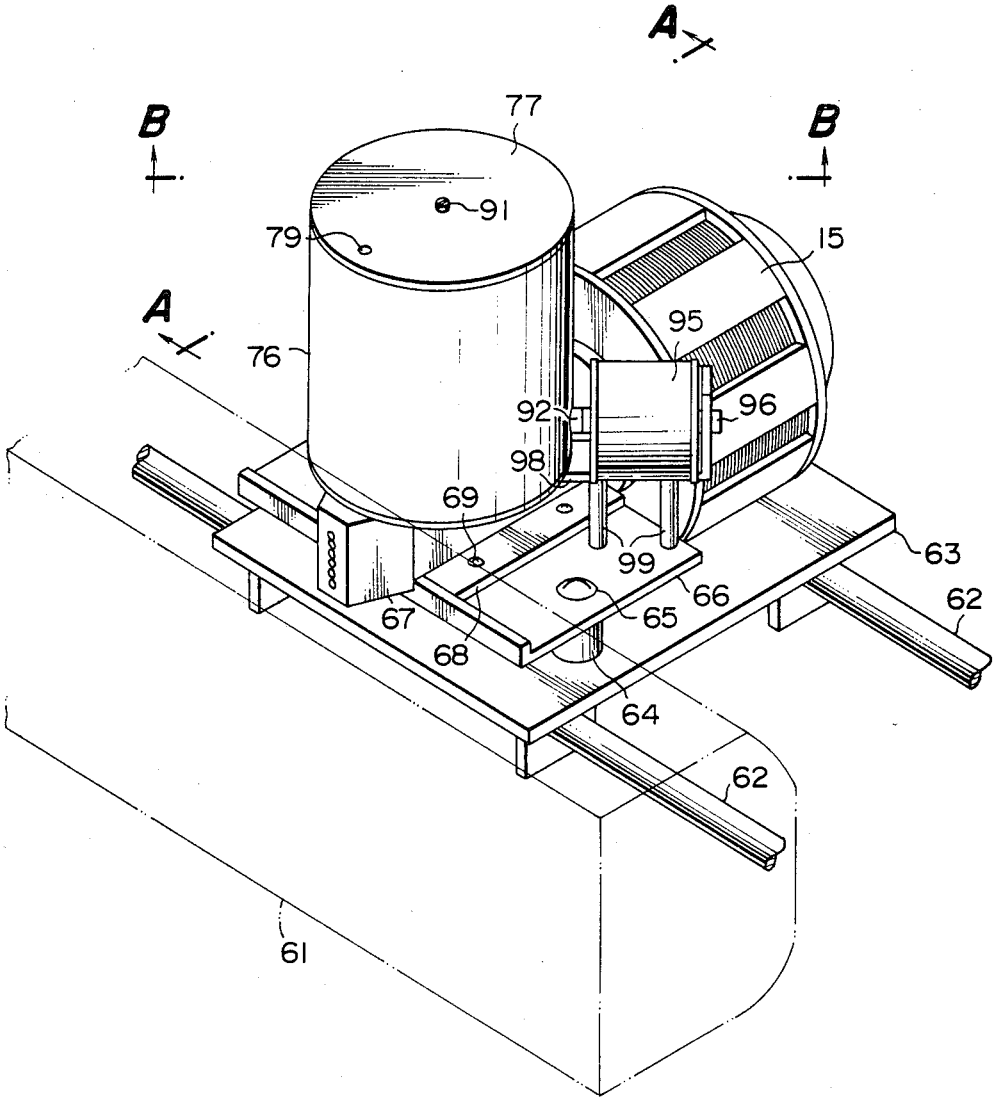
FIG. 8 is a perspective view showing a third embodiment of the present invention.

In a second embodiment of the present invention shown in FIGS. 5 to 7, an ink capsule for temperature compensation is provided to supply ink with more accuracy. That is, an ink supply device 45 in the second embodiment has an ink capsule 46 separately from the aforementioned ink supply device 25 in the first embodiment. This ink capsule 46 is mounted above a supporting frame 47 provided to support and fix the rear end of the housing 13 and the front end of the casing for solenoids. The supporting frame 47 is mounted on the carriage of the printer though not shown. As shown in greater detail in FIG. 6, the ink capsule 46 has a cylindrically formed pipe 48 within which is accommodated a comparing ink occlusion body 49 filled with ink, and closing caps 50 are fitted over opposite ends of the pipe 48. Into the ink occlusion body 49 are inserted a pair of comparison and detection electrodes 51 and 52 at suitable intervals like the detection electrodes 29 and 30. The ink occlusion body 49 is formed of the same material as that of the ink occlusion body 17 and has the same volume as the body 17. The quantity of ink within the ink capsule 46 is somewhat larger than that of the ink occlusion body 17 of the printing head 11, and both the ink occlusion bodies 17 and 49 are substantially the same in temperature characteristic. The ink capsule 46 is moved together with the printing head 11 but the ink capsule 46 is interiorly filled with ink and completely closed and therefore the liquid surface will not roll and flow. When ink expands or contracts due to the change in temperature, ink possibly leaks from the capsule 46 or produces bubbles. However, if the pipe 48 is formed of polyethylene, for example, it is possible to prevent a leakage of ink. Also, even if bubbles are generated, the bubbles will not reach the detection electrodes 51 and 52 by the provision of the ink occlusion body 49 to prevent the detection electrodes from being affected. Thus, the comparing detection voltage output signal changes merely depending on the temperature by the provision of the ink capsule 46. These detection electrodes 51 and 52 are connected to a detection circuit 53. Output of the detection circuit 53 is connected to an input of a control circuit 54.

The detection circuit 53 comprises, as shown in FIG. 7, fixed resistors 55 and 56 connected to the detection electrodes 30 and 52, respectively, and an AC pulse oscillator 57 connected to the resistors 55 and 56, respectively. The other end of the pulse oscillator 57 and the electrodes 29 and 51 are grounded. When the AC voltage of the AC pulse oscillator 57 is applied to the electrodes 30 and 52 through the fixed resistors 55 and 56, detection voltages $V_1$ and $V_2$ develop across the electrodes 30 and 52, respectively. Since the ink capsule 46 is filled with ink, voltage $V_2$ varies depending on the temperature alone. On the other hand, voltage $V_1$ of the printing ink occlusion body 17 gradually varies as the printing head 11 is actuated to decrease ink, and also varies as the temperature varies.

These detection voltages $V_1$ and $V_2$ are applied in parallel to the control circuit 54. This control circuit 54 comprises a differential amplifier circuit 58, a rectifier circuit 59 and a comparator circuit 60 which are connected in series. First, the detection voltages $V_1$ and $V_2$ obtain a differential voltage $V_3$ by the differential amplifier circuit 58. This differential voltage $V_3$ is a voltage corresponding to the quantity of ink in the printing occlusion body 17 with variation in detection voltage due to the change in temperature removed. The differential voltage $V_3$ is then converted into a DC voltage $V_3'$ by the rectifier circuit 59 after which it is fed to the comparator circuit 60. The comparator circuit 60 compares the differential voltage $V_3'$ with the upper limit voltage $V_s$ and lower limit voltage $V_u$ which serve as a predetermined reference, and when the differential voltage is below the lower limit voltage $V_u$, a valve opening signal is transmitted to the magnet or electromagnetic valve 28. Upon receipt of the valve opening signal, the magnet valve 28 opens to supply ink to the ink occlusion body 17. This supply of ink elevates the detection voltage $V_1$ and the differential voltage $V_3'$ exceeds the upper limit value $V_s$ accordingly, the control circuit 54 delivers a valve closing signal to the magnet valve 28. Similar operation is repeated whereby the quantity of ink in the printing ink occlusion body 17 can be always maintained constant to provide a required quality of printing.

In accordance with the second embodiment, since the ink capsule 46 with the comparing ink occlusion body 49 accommdated therein is closed with ink filled therein, a flow of ink within the ink capsule hardly occurs even if the ink capsule 46 vibrates as the printing operation proceeds, and thus, variation in detection voltage due to mechanical vibrations can be extremely decreased. Experiments reveal that voltage variation due to the vibration was less than about 1/5 as compared to the case where the comparing ink occlusion body 49 is accommodated in the ink tank 26. Also, the quantity of ink within the capsule 46 is approximately the same as the quantity of ink contained in the printing ink occlusion body 17, and the ink capsule 46 is positioned as close as possible to the printing ink occlusion body 17. Therefore, these two ink occlusion bodies are approximately the same in temperature characteristic and the environmemtal temperature approximates. Therefore, it becomes possible to perform accurate temperature compensation.

Figure 9:
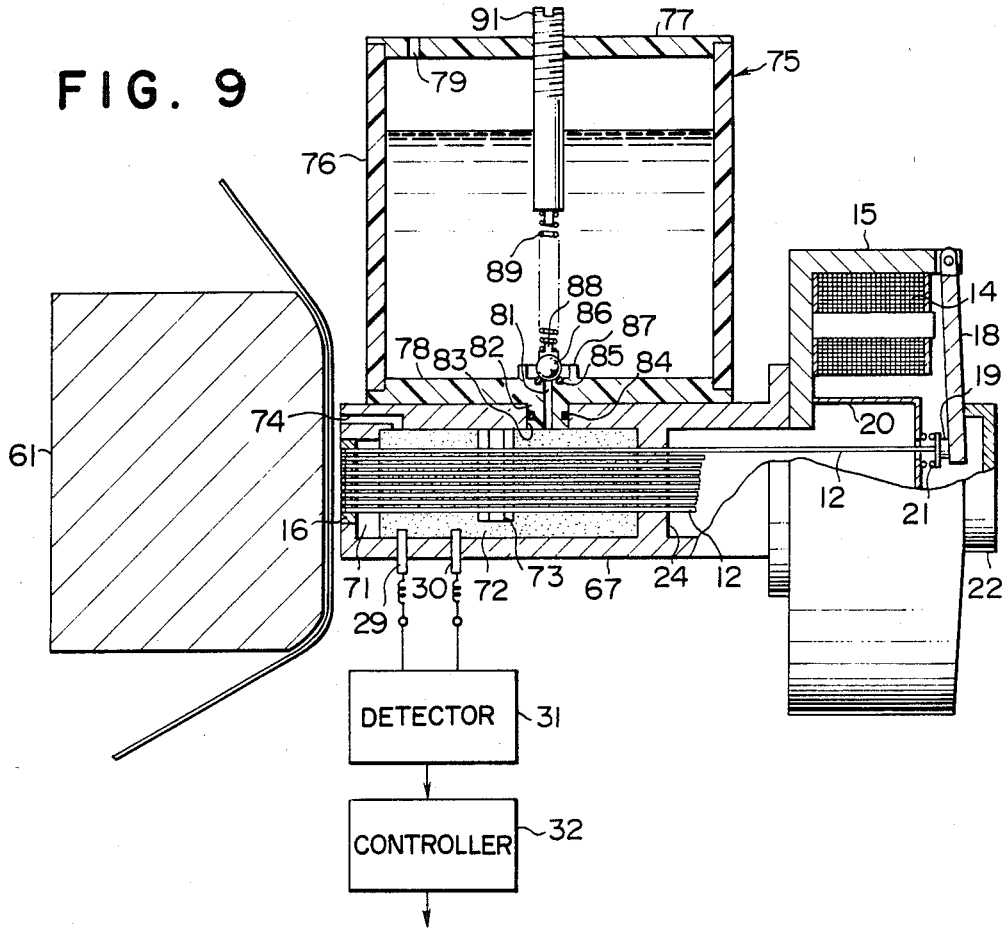
FIG. 9 is a sectional view taken on line A—A of FIG. 8.
Figure 11:
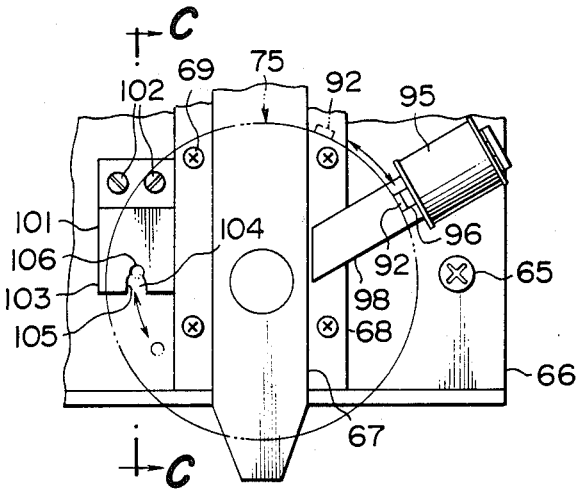
FIG. 11 is a plan view showing a part of a head supporting plate in FIG. 8.
Figure 12:
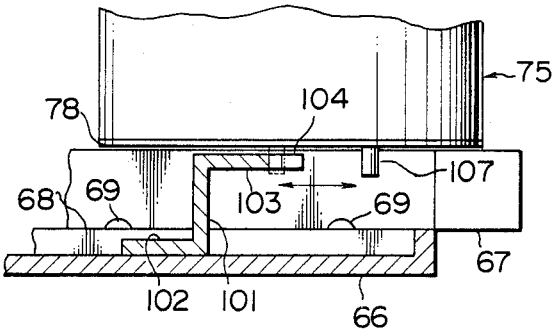
FIG. 12 is a sectional view taken on line C—C of FIG. 11.
Figure 13:
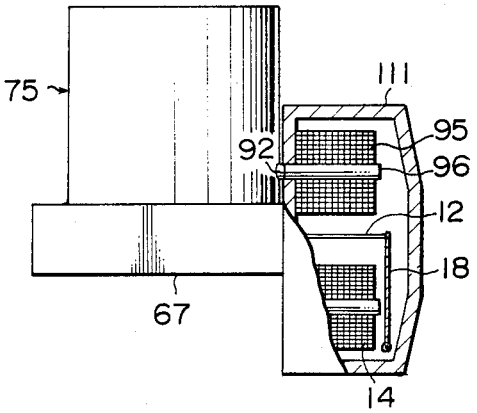
FIG. 13 is a sectional side view showing the outside of a solenoid receiving portion of FIG. 8.

While in the above described embodiments, ink from the ink tank is supplied to the printing ink occlusion body through the supply pipe, it is noted that in a third embodiment of the present invention shown in FIGS. 8 to 12, an ink supply device in which an ink supply route is shortened is provided. In the third embodiment, the ink supply device is mounted on a carriage 63 slidably mounted on two guide rails 62 disposed in parallel along a platen 61. This carriage 63 is designed so that the carriage may be moved laterally, by means of a suitable carriage feed mechanism not shown, in accordance with printing operation or returning operation. A head retaining plate 66 is mounted on the upper surface of the carriage 63 by means of a screw 65 through a spacer 64. A housing 67 for the printing wires 12 is secured to the head retaining plate 66 by inserting screws 69 into the head retaining plate 66 from a flange 68 integrally provided on the lower surface of the housing. The casing 15 with the solenoid 14 accommodated therein is mounted on the rear end of the housing 67. As shown in FIG. 9, the housing 67 has a window 16 for the passage of the printing wires 12 mounted on the extreme end thereof, an ink chamber 71 is provided between the wire guide 16 and an intermediate wall 24, and a printing ink occlusion body 72 is inserted into the ink chamber 71. In this embodiment, since the ink chamber is larger than that of the aforementioned embodiment, an intermediate guide wall 73 is provided as a guide for the printing wires 12 in the middle of the ink occlusion body 72, each of the printing wires 12 extending through the guide wall 73. The detection electrodes 29 and 30 are in contact with the ink occlusion body 72 in a manner similar to the aforementioned first embodiment. At the upper part of the extreme end of the housing 67 is provided an air hole 74 which opens to the ink chamber 71. This air hole 74 is provided so that when the ink chamber 71 is closed, pressure within the ink chamber 71 assumes negative pressure through the quantity in which ink is extruded during the printing operation to prevent air from being suctioned through the printing wire portions when the printing wires 12 are returned. It will understood that the air hole 74 can be easily provided even in the aforementioned first embodiment though not shown.

An ink tank 75 for storing replenishing ink is detachably mounted above the housing 67. This ink tank 75 is composed of a cylindrical side wall 76, a top cover 77 and a bottom cover 78. The top cover 77 is formed with a pressure regulating air hole 79. The bottom cover 78 has an ink supplying supply hole 81 extended through a central portion thereof and has an annular projection 82 formed in the lower surface thereof to form an extended portion of the supply hole 81. A receiving hole 83 is formed in the upper surface of the housing 67 so that the annular projection 82 may be fitted into the receiving hole, the annular projection 82 having a length set so as not to be projected into the ink chamber 71 when the former is fitted in the receiving hole 83. An O-ring 84 is mounted in the outer periphery of the annular projection 82 to maintain air tightness when fitted. A ball valve 86 whose seat comprises the O-ring 85 is provided on the upper end of the supply hole 81 of the bottom cover 78. The bottom cover 78 is formed in the center of the upper surface thereof with an annular rib 87 suitably spaced apart from the ball valve 86. This ball valve 86 is formed of a magnetic material, for example, such as soft iron, nickel, cobalt, etc. Alternatively, the outer peripheral surface of the ball valve 86 can be coated with a fluororesin film to prevent corrosion caused by ink. The ball valve 86 is normally biased downwardly by means of a compression spring 89 through a ball keep member 88. The upper end of the compression spring 88 is mounted on the lower end of an adjust screw 91, which is in turn screwed into the central portion of the top cover 77. Accordingly, a biasing force of the ball valve 86 can be suitably adjusted by rotating the screw 91. On the upper surface of the bottom cover 78 is provided a bar-like magnetic member 92 extending in a radial direction and having one end positioned with a slight gap from the ball valve 86. The other end of the magnetic member 92 is projected outwardly from the side wall 76. An O-ring 93 is fitted in a portion of the inner surface of the side wall 76 where the magnetic member 92 extends through, and the ring 93 and a flange 94 provided on the magnetic member 92 coorperate to prevent ink from leaking therefrom. The other end of the magnetic member 92 comes into contact with one end of a core 96 of a valve driving solenoid 95. When the valve driving solenoid 95 is energized under this condition, the magnetic member 92 and ball valve 86 are magnetized with the magnetic member 92 serving as a magnetic path. And, the ball valve 86 is attracted, by Coulomb's force, toward the extreme end of the magnetic member 92 against the biasing force of the compression spring 89. Subsequently, when the solenoid 95 is deenergized, the ball valve 86 is returned onto the O-ring 85 by movement of the compression spring 89 to close the ball valve 86. The amount of movement of the ball valve 86 required for opening and closing the same is small and the ball valve is not disengaged from the compression spring 89. The valve driving solenoid 95 is secured at one end to the other end of the core 96 and the other end has a yoke 98 bent approximately into an L-shape so as to form a horizontal portion 97 which extends below the solenoid 95 and parallel to the holding plate 66. The horizontal portion 97 of the yoke 98 is secured to the head holding plate 66 by means of screws 100 through spacers 99. The horizontal portion 97 of the yoke 98 is made to extend close to the housing 67 along the lower side of the bottom cover 78 of the ink tank 75 to thereby decrease magnetic resistance between the ball valve 86 positioned in the central portion of the ink tank 75 and the solenoid 95 located externally of the ink tank 75 to insure positive operation. In addition, by improving the efficiency of the solenoid 95, the device can be miniaturized and made light-weight and an excitation current can be made small. On the other hand, if the supply port 81 and the ball valve 86 are provided in the central portion of the ink tank 75, the ink tank 75 may be worked and assembled simply, and it is possible to extremely easily perform the tasks of mounting the ink tank 75 on the housing 67 and positioning of the magnetic member 92. For certain reasons in terms of design, an outlet is provided in another place and the position of the ball valve 86 is changed. This modification can be easily performed merely by adequate arrangement of the magnetic member 92 and the yoke 98 without impairing the operation. As described above, in the third embodiment, since the supply pipe used to connect the valve to the ink tank need not be provided, flow resistance is decreased and replacement of the ink tank can be done extremely easily.

The ink tank 75 can be mounted or detached by means of a lock member 101 mounted on the head holding plate 61. The lock member 101 is screwed at one end to the head holding plate 66 by means of screws 102, and the other end thereof is formed with a horizontal portion 103 bent into a substantially inverted L-shape. This horizontal portion 103 is located slightly lower than the upper surface of the housing 67. The horizontal portion 103 is formed at the extreme end with an engaging groove 104, which comprises a loose groove 105 at an inlet and a fitting groove 106 formed in the inner part of the groove 105. Corresponding to the lock member 101 is projectingly provided a pin 107 on the lower surface of the bottom cover 78 of the ink tank 75, and when the ink tank 75 is turned clockwise in FIG. 11 after the annular projection 82 of the ink tank 75 has been fitted into the receiving hole 83 of the housing 67, the pin 107 is snapped into the fitting groove 106 of the engaging groove 104 whereby the ink tank 75 is fixed and at the same time the magnetic member 92 is positioned to the core 96. If the ink tank 75 is turned counterclockwise reversely to the former, the pin 107 is released from the fitting groove 106 and the ink tank 75 can be removed from the housing 67 simply.

If the ink tank 75 and only at least a portion of the side wall 76 are formed of a transparent material, the quantity of ink can be checked at once by visual inspection in the vicinity of the printing head to insure printing. Alternatively, in the event that ink within the ink tank 75 has reduced in quantity, the ink tank 75 can be replaced. It should be noted that the valve driving solenoid 95 is controlled by the output signal of the control circuit 32 in a manner similar to that of the above described first embodiment. Also, in the case the solenoid 95 produces an intense magnetic force, the magnetic member 92 need not be always provided.

While in the third embodiment, the printing solenoid 14 is located apart from the valve driving solenoid 95, it should be noted that the valve driving solenoid 95 is made to assume the position in the neighbourhood of the printing solenoid 14 in away that both the solenoids may be accommodated within one and the same casing 111.

Figure 14:
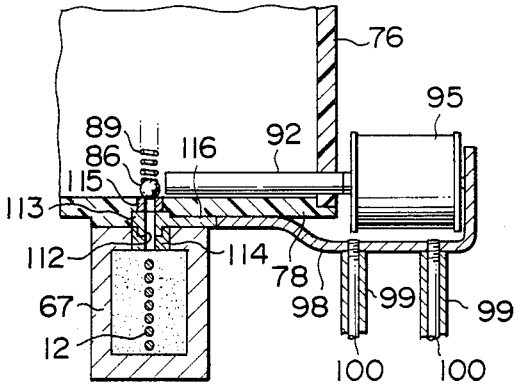
FIG. 14 is a sectional view showing another embodiment of a connection mechanism between an ink tank and a housing of the printing head.
Figure 15:
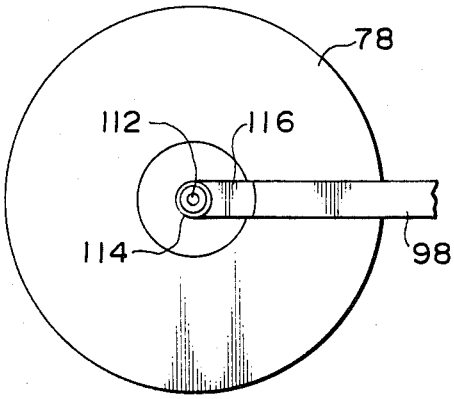
FIG. 15 is a plan view showing a bottom of the ink tank in FIG. 14.

FIGS. 14 and 15 illustrate another embodiment of a connection mechanism between the ink tank 75 and the housing 67. In this embodiment, in place of the annular projection 82 of the ink tank 76 in the above described third embodiment, there are provided a substantially annular magnetic piece 113 with a supply hole 112 extended through a center portion thereof and a cap 114 fitted in the lower end of the magnetic piece 113. The upper end of the magnetic piece 113 presses the ball valve 86 through a spacer 115 formed of a non-magnetic material such as plastics. The magnetic piece 113 is integrally formed at an upper portion with a bed 116 having the same wall thickness and width as those of the yoke 98 of the solenoid 95, the bed 116 having the extreme end in contact with the end of the yoke 98 as shown. In this embodiment, the yoke 98 of the solenoid 95 is bent in the midst thereof so as to come into contact with the bottom cover 78 of the ink tank 75. With this arrangement, if gaps other than the ball valve 86 and the magnetic member 92 are minimized and the ball valve 86 is positioned adjacent to the magnetic member 92, the entire magnetic resistance can be further decreased.

Figure 16:
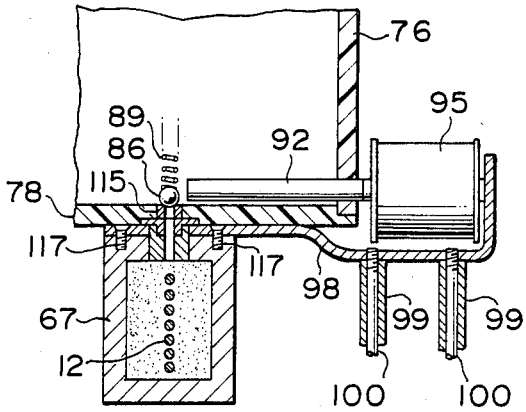
FIG. 16 is a sectional view showing a still another embodiment of the connection mechanism between the ink tank and the housing of the printing head.

FIG. 16 shows still another embodiment of the connection mechanism between the ink tank 75 and the housing 67. The yoke 98 of the valve driving solenoid 95 is made to extend up to the upper surface of the housing 67 and secured to the housing 67 by means of screws 117. A magnetic piece 118 similar to the aforementioned magnetic piece 113 is formed with a collar 119, which is in contact with the yoke 98. Accordingly, the entire magnetic resistance can be decreased similarly to the previous embodiments of FIGS. 14 and 15.

It should be noted of course that in the first first embodiment, the magnetic valve is removed and the ball valve as in the above described third embodiment can be provided within the ink tank.

Alternatively, only one electrode can be provided slightly away from the ink occlusion body.

What is claimed is:

1. An ink supply device for an inking type wire dot printer comprising: a housing, a plurality of, printing wires supported projectably from one end of said housing, a plurality of wire driving means driven so as to individually project said printing wires from said one end of the housing, an ink chamber having a printing ink occlusion body disposed with the housing and into which the printing wires extend, an ink tank connected to supply ink to said ink occlusion body, valve means for electrically controlling the supply of ink from within the ink tank to the ink occlusion body, a pair of spaced detection electrodes for detection of the printing ink, the electrodes having upper ends which project from a lower surface to the interior of the housing and which press against the ink occlusion body, and a detection control circuit operative to control the valve means tp be turned ON or OFF by output signals from said detection electrodes, said ink occlusion body being positioned so that a lower surface thereof is positioned at a predetermined spacing from the lower surface of the housing such that the electrodes project into the spacing from the lower surface of the housing.

2. An ink supply device according to claim 1, wherein said printing ink detection electrodes each comprise a strip-like plate member, each plate member having an upper end which is bent substantially at a right angle, the bent portions having an upper surface which press against the lower surface of said ink occlusion body and having a lower surface which bear on said lower surface of said housing, whereby the thickness of said plate member defines said required space.

3. An ink supply device according to claim 1, further comprising a sealed ink capsule filled with ink, a comparing ink occlusion body disposed within the ink capsule, and a pair of spaced comparing detection electrodes disposed in contact with the comparing ink occlusion body, wherein the detection control circuit compares the output signals of the printing ink detection electrodes using an output signal of the comparing electrode as a reference signal to effect ON and OFF control of the valve means by a signal differential obtained therefrom.

4. An ink supply device according to claim 1, wherein said housing is provided with an air hole, one end of which is open to said ink chamber and the other end thereof is open to the exterior.

5. An ink supply device according to claim 1, wherein said valve means comprises a magnet valve.

6. An ink supply device according to claim 1, wherein said valve means comprises an inlet extending through the bottom of said ink tank, a ball valve formed of a magnetic material positioned so as to block said inlet, a biasing member for resiliently biasing said ball valve from the top, and a magnet means mounted externally of said ink tank and which moves said ball valve by means of a magnetic force when energized so as to open said inlet, said magnet means being controlled by said detection control circuit.

7. An ink supply device according to claim 1, wherein the upper surface of said housing is formed with a through hole in communication with said ink chamber, and said valve means comprises a supply pipe, one end of which is open from the bottom of said ink tank into said ink tank and the other end thereof is projected from said bottom and in contact with said printing ink occlusion body from said through hole, a ball valve formed of a magnetic material positioned so as to block the upper end of the supply pipe, a biasing member for resiliently biasing said ball valve from the top, and a magnet means mounted externally of said ink tank and for moving said ball valve by means of a magnetic force when energized so as to the upper end of said supply pipe, whereby said ink tank is mounted on said housing.

8. An ink supply device according to claim 6 or 7, which comprises a rod member formed of a magnetic material, one end of which is positioned and spaced apart from said ball valve, the other end of said rod member being connected to said magnet means from said ink tank, whereby a magnetic path for said ball valve is formed by said rod member.

9. An ink device according to claim 8, wherein said magnet means comprises a plunger and the yoke thereof extends up to the neighbourhood of said ball valve passing along the external portion of said ink tank.

* * * * *